US012680203B2

(12) United States Patent
Meir

(10) Patent No.: US 12,680,203 B2
(45) **Date of Patent: *Jul. 14, 2026**

(54) KNITTED COMPONENT WITH AN INNER LAYER HAVING A THERMOPLASTIC MATERIAL AND RELATED METHOD

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 238 days.

This patent is subject to a terminal disclaimer.

(21) Appl. No.: 18/228,521

(22) Filed: Jul. 31, 2023

(65) Prior Publication Data

US 2023/0366136 A1 Nov. 16, 2023

Related U.S. Application Data

(63) Continuation of application No. 16/887,674, filed on May 29, 2020, now Pat. No. 11,739,448.
(Continued)

(51) Int. Cl.
*D04B 1/12* (2006.01)
*A43B 23/02* (2006.01)

(52) U.S. Cl.
CPC ..... *D04B 1/123* (2013.01); *A43B 23/0235* (2013.01); *D10B 2401/021* (2013.01); *D10B 2401/04* (2013.01); *D10B 2501/043* (2013.01)

(58) Field of Classification Search
CPC ..... D04B 1/123; A43B 23/00–06; B32B 5/26; B32B 5/279; B32B 7/10; B32B 7/12–14; C08J 5/24–249; B29C 70/22–222
See application file for complete search history.

(56) References Cited

U.S. PATENT DOCUMENTS 8,448,474 B1 5/2013 Tatler et al.
9,404,205 B2 8/2016 Meir
(Continued)

FOREIGN PATENT DOCUMENTS

CN 106037194 A 10/2016
CN 207341288 U 5/2018
(Continued)

OTHER PUBLICATIONS

Office Action received for European Application No. 20746366.2, mailed on Aug. 7, 2024, 10 pages.
(Continued)

*Primary Examiner* — Larissa Rowe Emrich
(74) *Attorney, Agent, or Firm* — Shook, Hardy & Bacon L.L.P.

(57) ABSTRACT

A method may include one or more of the following steps: knitting a first knit layer and a second knit layer on a knitting machine, where the first knit layer and the second knit layer each include a plurality of intermeshed loops, and where at least one loop of the first knit layer is intermeshed with at least one loop of the second knit layer; inlaying an inlaid strand between the first knit layer and the second knit layer during the knitting of the first knit layer and the second knit layer, where the inlaid strand includes a thermoplastic material having a melting point; and applying heat to at least a portion of the thermoplastic material of the inlaid strand such that the portion of the thermoplastic material rises to a temperature at or above the melting point.

19 Claims, 12 Drawing Sheets

Related U.S. Application Data

(60) Provisional application No. 62/855,486, filed on May 31, 2019.

(56) References Cited

U.S. PATENT DOCUMENTS

| | | | | |
|---|---|---|---|---|
| 9,682,512 | B2 | 6/2017 | Dua et al. | |
| 9,745,677 | B2 | 8/2017 | Dua et al. | |
| 10,458,052 | B2 | 10/2019 | Adami et al. | |
| 11,155,944 | B2 | 10/2021 | Adami et al. | |
| 2013/0260104 | A1* | 10/2013 | Dua | B29C 66/223 428/196 |
| 2013/0269209 | A1* | 10/2013 | Lang | A43B 1/04 12/146 C |
| 2014/0310983 | A1 | 10/2014 | Tamm et al. | |
| 2017/0196303 | A1 | 7/2017 | Davis et al. | |
| 2018/0125158 | A1 | 5/2018 | Adami et al. | |
| 2018/0125159 | A1 | 5/2018 | Adami et al. | |
| 2018/0125165 | A1 | 5/2018 | Adami et al. | |
| 2018/0127904 | A1 | 5/2018 | Adami et al. | |
| 2018/0220741 | A1 | 8/2018 | Adami et al. | |
| 2019/0069635 | A1 | 3/2019 | Lang et al. | |
| 2019/0069636 | A1 | 3/2019 | Lang et al. | |
| 2019/0069637 | A1 | 3/2019 | Lang et al. | |
| 2019/0069638 | A1 | 3/2019 | Lang et al. | |
| 2019/0075889 | A1 | 3/2019 | Lang et al. | |
| 2020/0375317 | A1 | 12/2020 | Meir | |

FOREIGN PATENT DOCUMENTS

| | | | |
|---|---|---|---|
| CN | 108656590 | A | 10/2018 |
| CN | 108699738 | A | 10/2018 |
| CN | 208791897 | U | 4/2019 |
| CN | 210076733 | U | 2/2020 |
| EP | 2649898 | A1 | 10/2013 |
| WO | 2012/151408 | A2 | 11/2012 |
| WO | 2015/116295 | A1 | 8/2015 |
| WO | 2018/089686 | A1 | 5/2018 |

OTHER PUBLICATIONS

Partial European Search Report received for European Patent Application No. 25205442.4, mailed on Jan. 20, 2026, 16 pages.

* cited by examiner

KNITTED COMPONENT WITH AN INNER LAYER HAVING A THERMOPLASTIC MATERIAL AND RELATED METHOD

CROSS-REFERENCE TO RELATED APPLICATIONS

This application is a continuation of U.S. patent application Ser. No. 16/887,674 filed on May 29, 2020, and also claims the benefit of U.S. Provisional Application No. 62/855,486, filed May 31, 2019. The contents of each of which are hereby incorporated by reference in their entirety.

TECHNICAL FIELD

The present disclosure relates generally to knitted components and methods of manufacturing knitted components, for example, knitted components for use in footwear applications, apparel applications, or the like.

BACKGROUND

The present disclosure relates generally to a knitted component having a selected region of macro-texture and the method for forming a method a knitted component having a selected region of macro-texture. The disclosure also relates to an article of footwear having an upper made in accordance with this disclosure.

A variety of material elements (e.g., textiles, polymer foam, polymer sheets, leather, synthetic leather) are conventionally utilized in manufacturing knitted items such as knitted uppers. In athletic footwear, for example, the upper may have multiple layers that each include a variety of joined material elements. As examples, the material elements may be selected to impart stretch-resistance, cushion, low-friction, wear-resistance, flexibility, air-permeability, compressibility, comfort, water-resistance, and moisture-wicking to different areas of the upper. Moreover, the material elements are often joined in a layered configuration to impart multiple properties to the same areas.

Wearers of articles of footwear may desire articles of footwear that are durable for functionality, precisely shaped for comfort of wear, decoration, or aerodynamics, and soft-textured for comfort of wear. Such users may seek to maximize these properties and characteristics. Many construction techniques have been employed to achieve such a result. Examples of such construction include use of multiple layers of soft material for comfort, waterproof or high-tensile strength materials for durability, are applied items for shape and marking.

However, as those with skill in the art recognize, combining disparate materials is such a way creates additional steps, as well as waste, in the manufacturing process. Also, layers of materials or joints between different materials of construction may present assembly and maintenance burdens.

Therefore, there exists a need in the art for a method for manufacturing uppers for articles of footwear that minimize the number of manufacturing steps while reducing raw material waste.

BRIEF DESCRIPTION OF THE DRAWINGS

In order that the disclosure may be well understood, there will now be described various forms thereof, given by way of example, reference being made to the accompanying drawings, in which.

DETAILED DESCRIPTION

Figure 1:
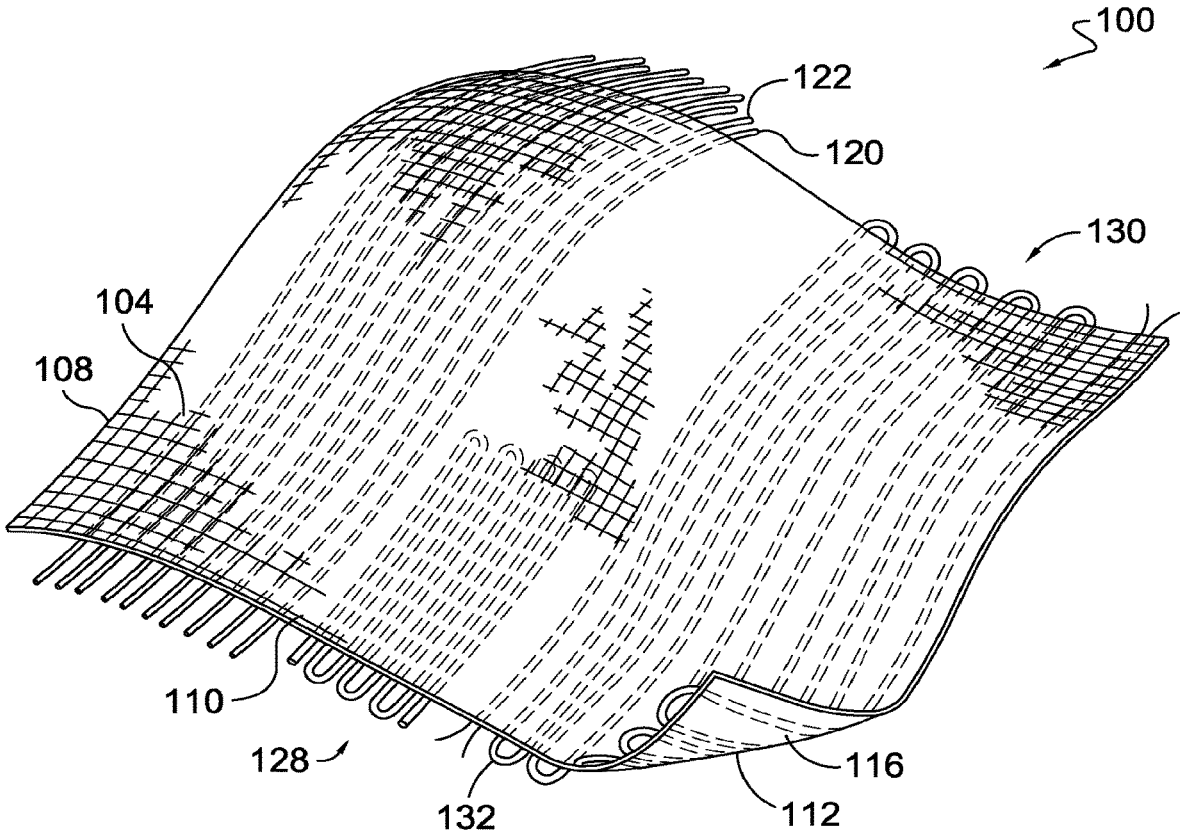
FIG. 1 is a perspective view of the outer surfaces of the knitted component with implied inlaid yarn.

While various embodiments of the present disclosure have been described, the present disclosure is not to be restricted except in light of the attached claims and their equivalents. Moreover, the advantages described herein are not necessarily the only advantages of the present disclosure and it is not necessarily expected that every embodiment of the present disclosure will achieve all of the advantages described.

The disclosure will be described in detail as it relates to a region or regions of structural stiffness. Structural stiffness may be described or characterized as resistance to permanent deformation, akin to more traditional measures of material properties such as the Young's modulus measure of resilience, but specific to the ability of the component to retain or return to a given morphology of its maco-texture after loading. In this disclosure, the regions may be described as providing or having different rigidity, resilience, structure, structural stiffness, or bending resistance, for example. These and other words or phrases that have essentially the same meanings and indicate or describe similar phenomena in the disclosure.

Low-melt thermoplastic yarn imparts structural stiffness to a section of the knitted component after heat or pressure processing by anchoring a plurality of knit layers together over the area where the area where the processed low-melt thermoplastic yarn has been processed. By softening and reforming the thermoplastic yarn in a new morphology, or "macro-texture," the processed low-melt thermoplastic layer imparts to the anchored knit layers the new macro-texture. By anchoring the layers together, the processed section of the knitted component demonstrates increased structural stiffness compared with the unprocessed knitted component. Thus, a knitted component section stiffened with processed low-melt thermoplastic yarn will resist permanent deformation of the new macro-texture.

One aspect of this disclosure is directed to a method for creating an integrally formed knitted component 100 having a selected region of macro-texture 900 after heat or pressure processing and a method for creating such a knitted component 100. Herein, a "macro-texture" may be referred to as a shape or texture extending through multiple layers of a textile such that it is discernable from both sides of the textile (e.g., opposite textile faces), whereas a "micro-texture" is generally isolated to one textile face. In the knitted component 100, a first knit layer 104 comprising a first high-melting point yarn 108 is located on the opposite side of the knitted component 100 from a second knit layer 112 comprising a second high-melting point yarn 116. The first yarn and the second yarn 108, 116 form interlocking knit stitches within the knitted component 100 (e.g., such that one or more loops forming the first knit layer 104 is interlooped with at least one loop forming the second knit layer 112). Thus, the majority of the yarn present in the first knit layer 104 is the first high-melting point yarn 108 and the majority of the yarn present in the second knit layer 112 is the second high-melting point yarn 116, although owing to the nature of the knitting process, a small amount of the first yarn 108 will be present in the second layer 112 (forming interlocking stitches) and a small amount of the second yarn 116 will be present in the first layer 112. While any specific yarn may be used as the first yarn 108 and/or the second yarn 116, in certain exemplary embodiments the first yarn 108 and/or the second yarn 116 may be primarily comprised of a polyester. A low-melting point thermoplastic inlaid strand 120 (which may be partially or fully formed of a thermoplastic material) is inlaid in the direction of the courses of the interlocked knit layers and may run the entire length of the knit layers, or may be inlaid in courses over only a selected portion of the knit layers. Notably, when referring to the inlaid strand 120. The number and direction of strands of low-melting point thermoplastic yarn are selected to yield the controlled structural stiffness after heat or pressure processing so as to maintain a macro-texture 900. The low-melting point thermoplastic strand 120 is softened through either applying heat or pressure to the knitted component 100.

Figure 2:
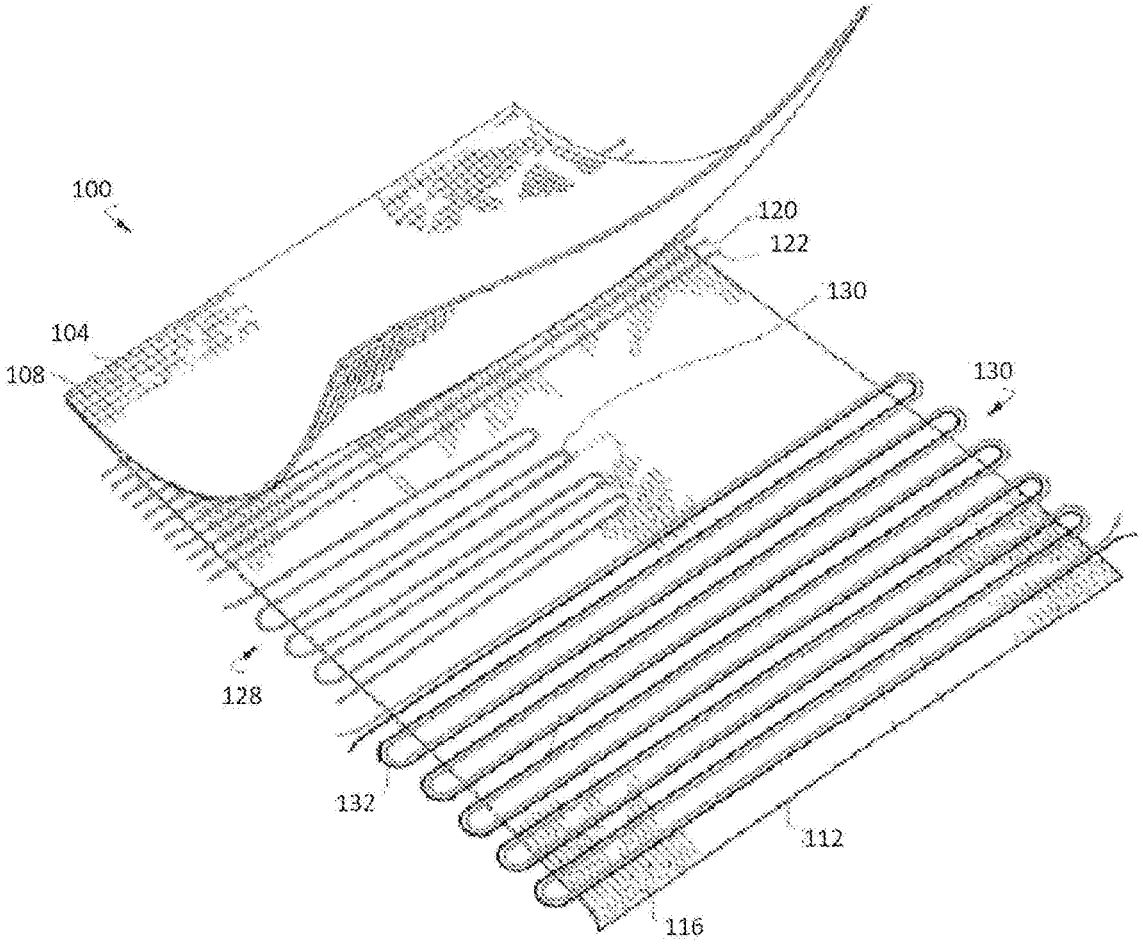
FIG. 2 is an exploded view of the inlaid yarn in the kit component.
Figure 3:
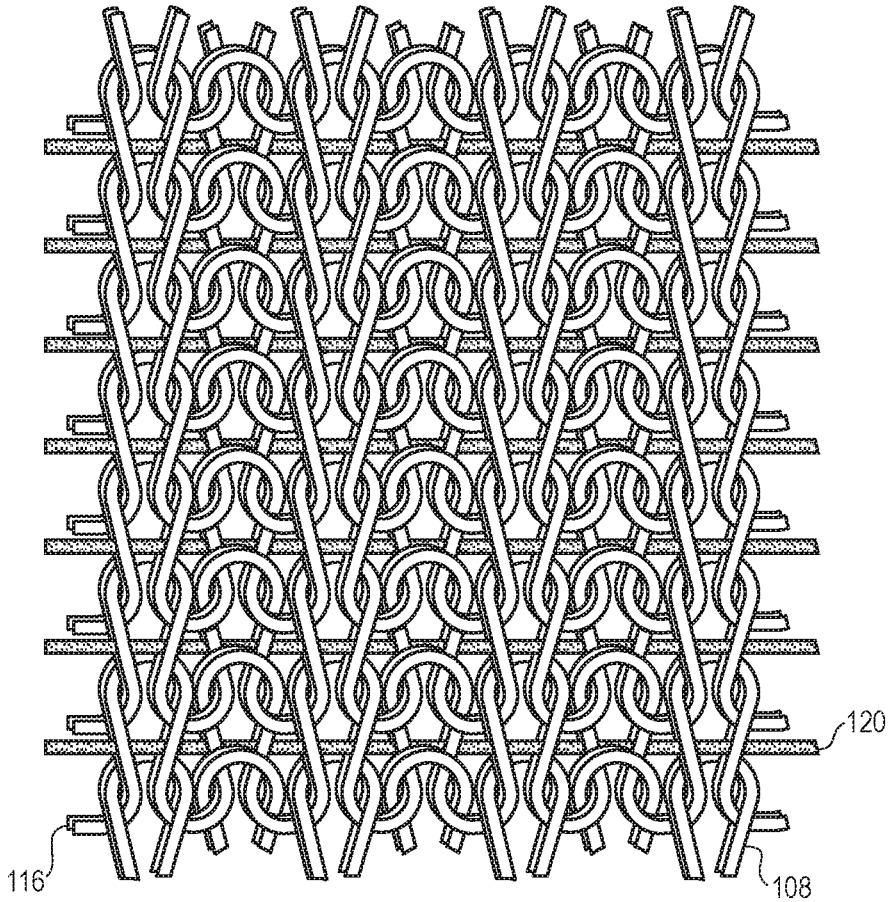
FIG. 3 is close-up rendering of one possible knit structure of a portion the knitted component with inlaid yarn.
Figure 4A:
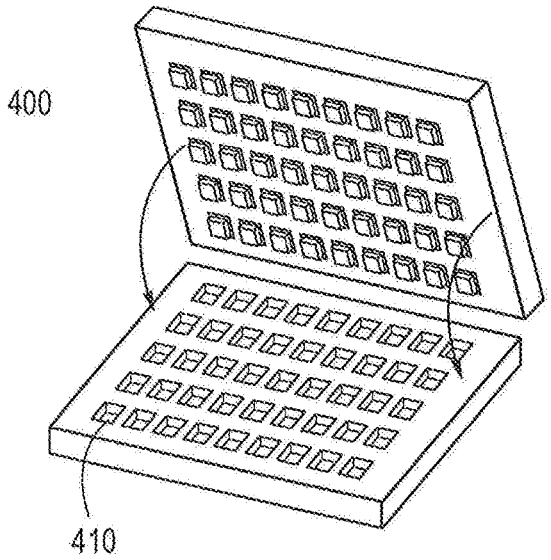
FIGS. 4A-D are perspective views of examples of pressure molds in which the knitted component may be placed for shaping.
Figure 4B:
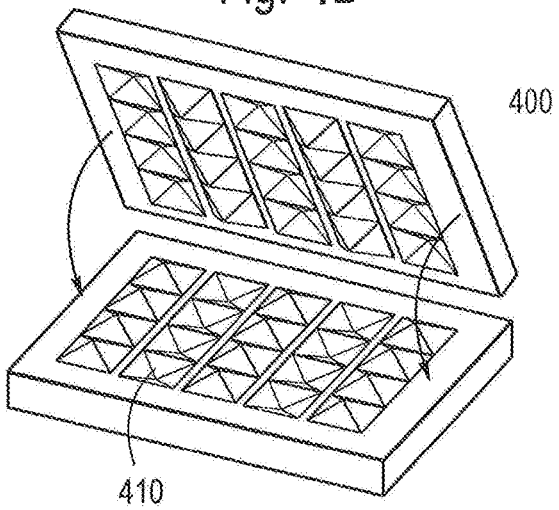
Figure 4C:
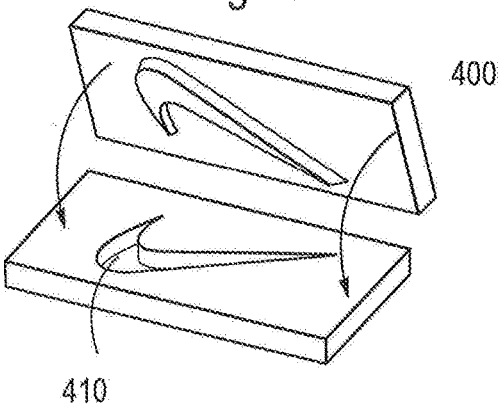
Figure 4D:
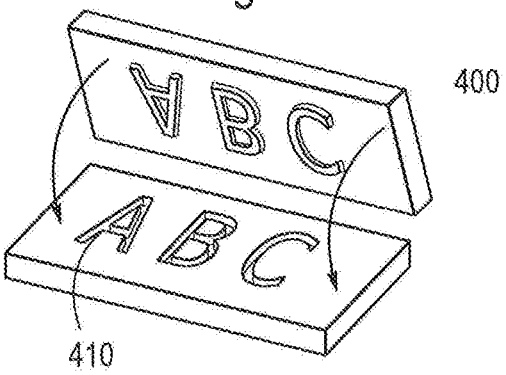

In one aspect, the disclosure provides a method for creating a knitted component 100 having a selected region of controlled stiffness after heat or pressure processing. One such knitted component is depicted in FIGS. 1 and 2. In accordance with the method, a knitted component 100 comprising high-melting point polymer yarn 108 is knitted. A low-melting point thermoplastic strand 120 is inlaid in the selected region 128 of the knitted component 100 in a number and direction sufficient to yield the controlled stiffness after processing. In another aspect, the knitted component may be formed by more three or more knit layers and two or more layers of low-melting point thermoplastic inlaid yarn.

In another aspect depicted in FIGS. 1 and 2, the disclosure provides a method for knitting a knitted component 100 having a first selected region 128 of a first controlled stiffness after processing and a second selected region 130 of a second controlled stiffness after processing. In accordance with the method, a knitted component 100 comprising high-melting point yarn 108 is knitted. A first low-melting point thermoplastic strand 120 is inlaid into the first selected region 128 of the knitted component 100 in a number and direction sufficient to yield a first controlled stiffness after processing. A second low-melting point thermoplastic yarn 122 is inlaid into the second selected region 130 of the knitted component 100 in a number and direction sufficient to yield a first controlled stiffness after processing.

In another aspect depicted in FIGS. 4A-10C, the disclosure provides a method for creating a knitted component 100 having a selected region of macro-texture 900 and controlled stiffness after heat or pressure processing.

Figure 9A:
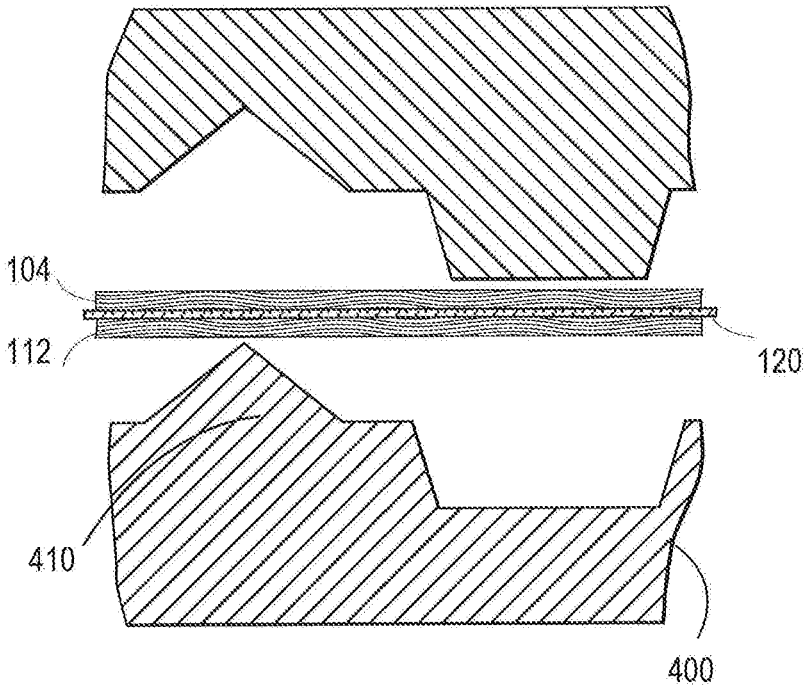
FIG. 9A is a cross sectional view of the knitted component detailing the a first and second knit layer and a low-melting point thermoplastic inly yarn of the knitted component and a pressure mold after heat has been applied to the knitted component, but before the knitted component is set into the pressure mold.
Figure 9B:
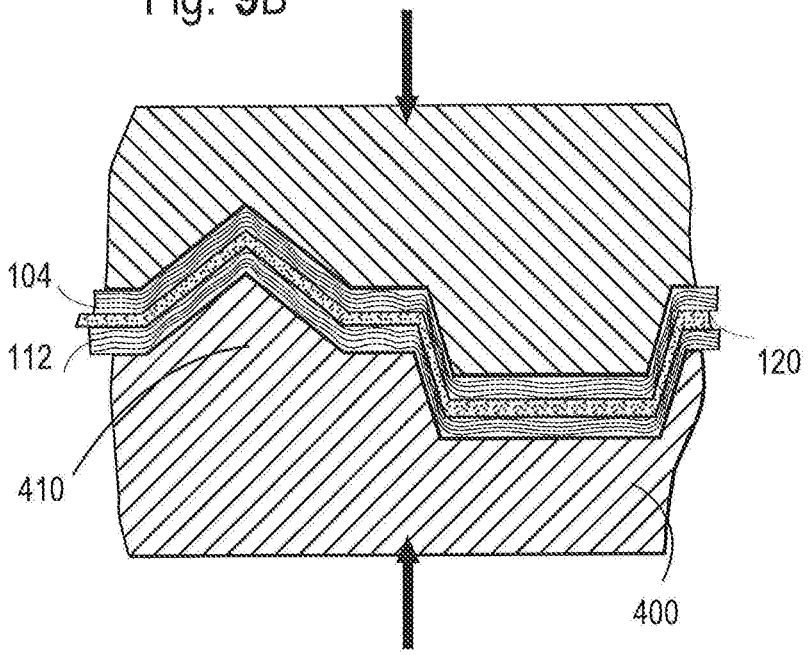
FIG. 9B is a cross sectional view of the knitted component of FIG. 9A after the knitted component is set into a first variation of a pressure mold and the pressure mold is engaged.
Figure 9C:
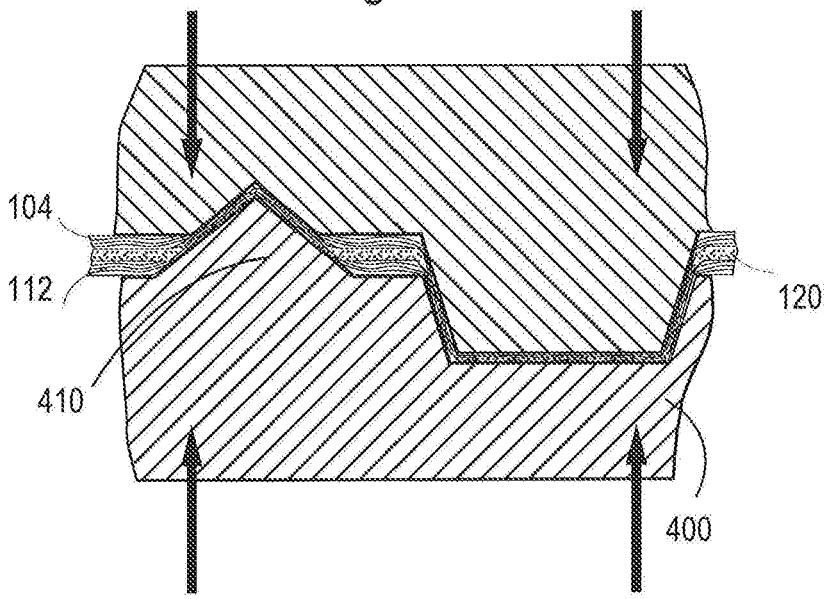
FIG. 9C is a cross sectional view of the knitted component of FIG. 9A after the knitted component is set into a second variation of a pressure mold and the pressure mold is engaged.
Figure 9D:
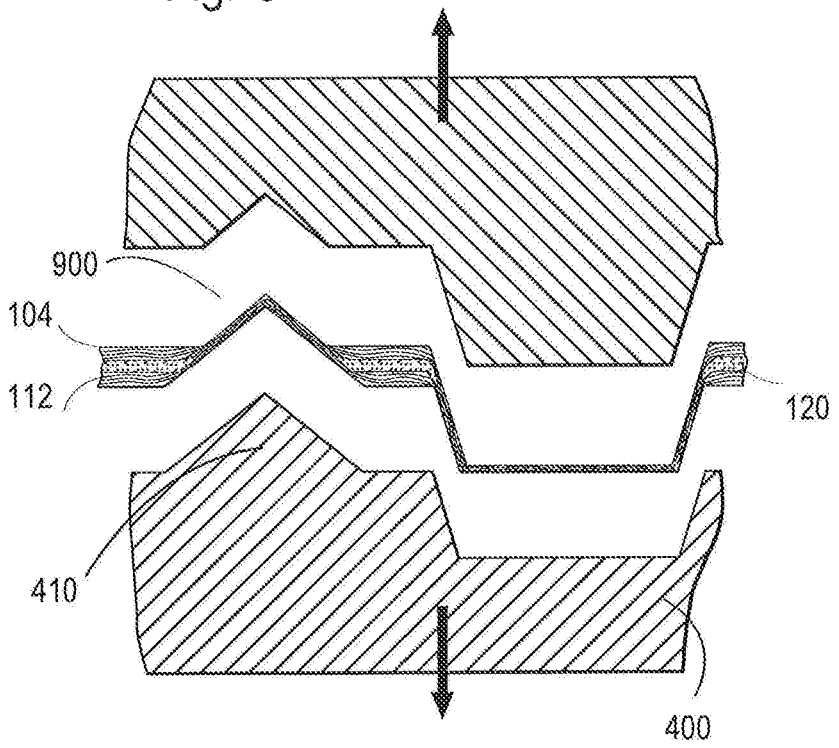
FIG. 9D is a cross sectional view of the knitted component of FIGS. 9A-C after the cooled knitted component is released from the pressure mold of FIG. 9C.
Figure 9E:
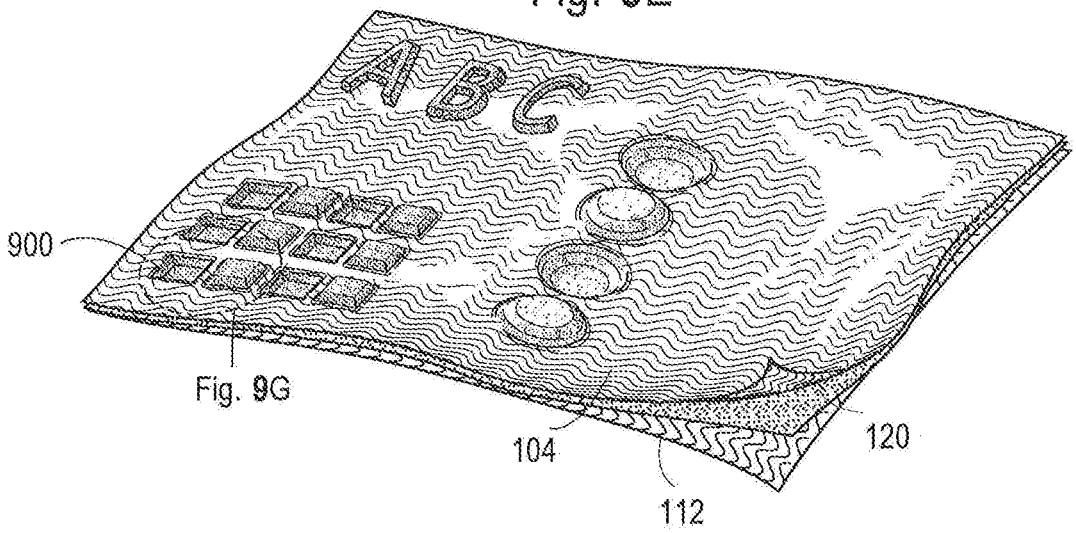
FIG. 9E is a perspective and partially exploded view of the knitted component of Figs. A-D showing a variety of macro-textures after pressure molding.

One such knitted component 100 is depicted in FIGS. 9D and 9E. In accordance with the method, a knitted component 100 comprising high-melting point polymer yarn 108 is knitted. A low-melting point thermoplastic strand 120 is inlaid in the selected region 128 of the knitted component 100 in a number and direction sufficient to yield the controlled stiffness after processing. The knitted component is processed to soften the low-melting point thermoplastic strand 120.

Figure 8:
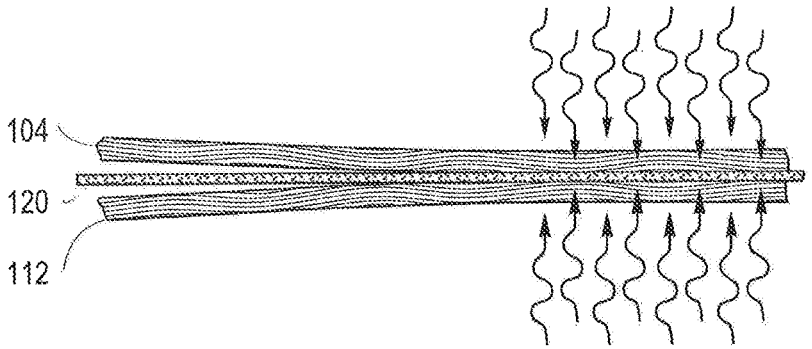
FIG. 8 is a cross sectional and partially exploded view of heat being applied to the of the knitted component with two knit layers and a low-melting point thermoplastic inly yarn.

In one aspect, as depicted in FIG. 8, the inlaid strand 120 may be softened by applying heat to the knitted component 120. The knitted component 100 is heated to soften the low-melting point thermoplastic strand 120. The knitted component may be heated by omnidirectional means, such as the use of steam, an oven, or equivalent, or by directional means, such as a hot surface, heat gun, or equivalent. Depending on the crystallinity or general characteristics of the yarn, to soften the low-melting point thermoplastic strand 120, the knitted component 100 can either be heated to or above the inlaid yarn's melting point, above the inlaid yarn's glass transition temperature, or to or above the inlaid yarn's softening point for a given processing pressure. When the softened inlaid strand 120 is cooled to a temperature below its softening point, the material becomes firm.

While the low-melting point thermoplastic yarn is softened, the knitted component is shaped using a mold press 400 (also referred to as a "mold press") having a macro-texture feature 410. Notably, the mold press 400 may be relatively cool relative to the melting temperature of one or more yarns in the knitted component (e.g., it may be maintained at room temperature). The mold press 400 generally either has a top portion and a bottom portion. The mold press can be a clamshell design, where the top portion and the bottom portion are hinged along one edge so that the knitted component may be insert between the top portion and the bottom portion and the mold press closed down on the knitted component 100. Alternatively, the top portion and bottom portion of the mold press 400 maybe be two independent plates that are not otherwise connected. In this alternative design the knitted component is positioned on top of the bottom portion of the mold press 400 and the top portion is then positioned on top of the knitted component 100. The top portion may be of similar size as the bottom portion, or may be larger or smaller. Although it is typical for the top portion and bottom portion to align so that macro-texture features 410 on the bottom portion align with corresponding macro-texture features 410 on the top potion, there is not a requirement. The top portion and bottom portions may have distinctly different macro-texture features 410, or the portions may be flat, thus without macro-texture features. As indicated in FIGS. 4A-4D, the macro-texture features 410 on the mold press 400 may be of a variety of shapes and patterns including, but not limited to, letters, words, phrases, numbers, logos, three-dimensional geometric designs, line drawings or sketches, signatures, or a combination of features.

Figure 5:
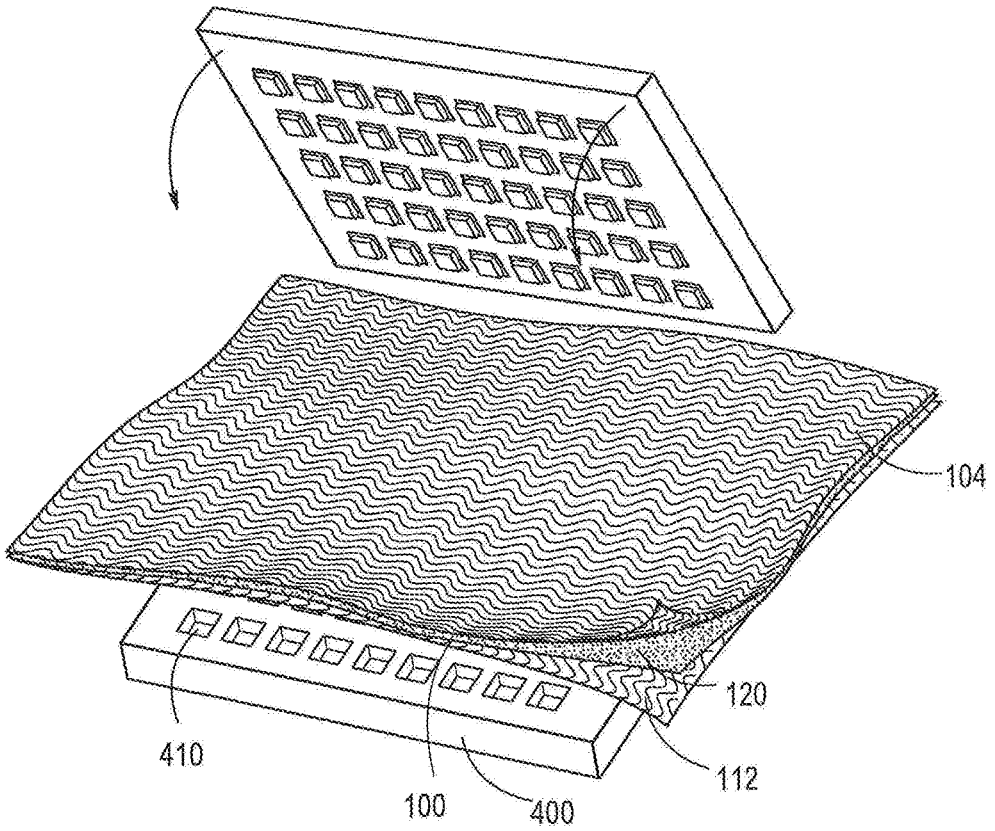
FIG. 5 is a perspective view of an example pressure mold and a partially exploded view of the knitted component placed on a pressure mold before shaping.
Figure 6:
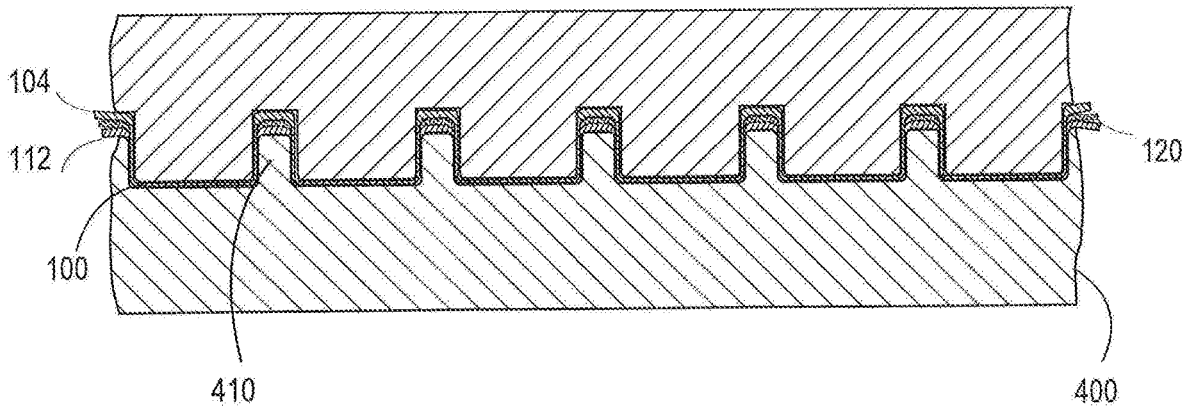
FIG. 6 is a cross sectional view of the knit article in the pressure mold of FIG. 5 while the pressure mold is engaged.
Figure 7:
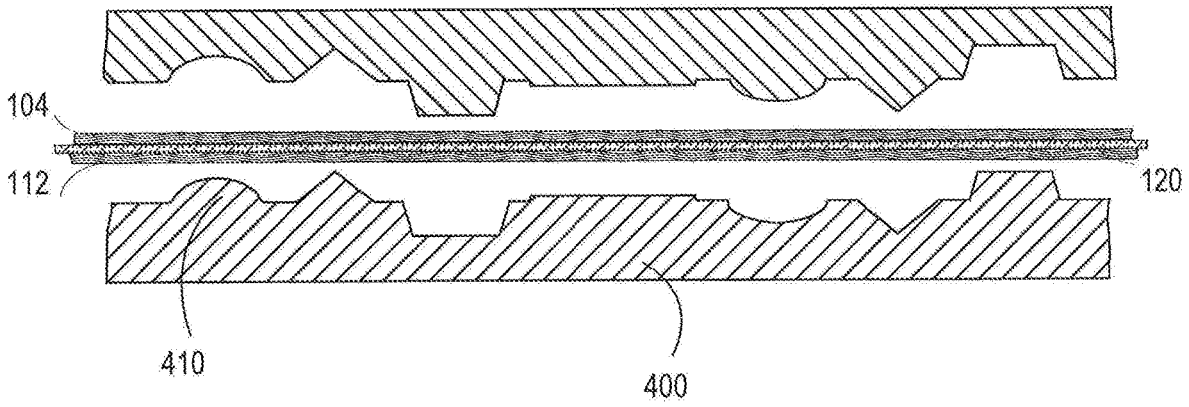
FIG. 7 is a cross sectional view of the knitted component detailing the a first and second knit layer and a low-melting point thermoplastic inly yarn of the knitted component and a pressure mold before the knitted component is positioned into the pressure mold.

As depicted in FIGS. 5 and 9B, after the knitted component 100 with softened low-melting point thermoplastic strand 120 is positioned into the mold press 400 and the mold press 400 is engaged, a sufficient amount of pressure is applied to the mold press 400 such that the softened low-melting point thermoplastic strand 120 deforms and the knitted component 100 conforms to the macro-texture feature 410 in the mold press 400. The amount of pressure will vary depend on the amount and temperature of the thermoplastic strand 120, the desired amount of infiltration of low-melt thermoplastic strand 120 into the knit layers 104, 112, among other factors. In one embodiment, the inherent weight of the top portion of the mold press will provide sufficient pressure to achieve the desired results, and no additional pressure is required. In another embodiment, additional pressure is applied to the press mold 410. As depicted in 9C, additional pressure may cause the low-melting point thermoplastic strand 120 to infiltrate the knit layers 104, 112 more than if only the inherent weight of the top portion of the mold press is applied, as depicted in FIG. 9C.

After the knitted component 100 conforms to the macro-texture features 410, the knitted component 100 is allowed to cool. This cooling allows the low-melt thermoplastic strand 120 to transition from its softened state to its firm state. Cooling may be accomplished by a variety of means including, but not limited to, allowing the knitted component to cool in the ambient, cooling one of both of the portions of the mold press 400 (and/or simply relying on conduction through the mold press 400 when the mold press is below the melting temperature of the thermoplastic strand 120, such as at room temperature), exposing the knitted component 100 to fluid that is at a lower temperature than the temperature of the softened low-melting point thermoplastic strand 120 including liquids and gasses, or other means. As depicted in FIG. 9D, after the knitted component 100 has the low melting point thermoplastic strand 120 has firmed, the knitted component 100 is removed from the mold press 400.

Figure 9F:
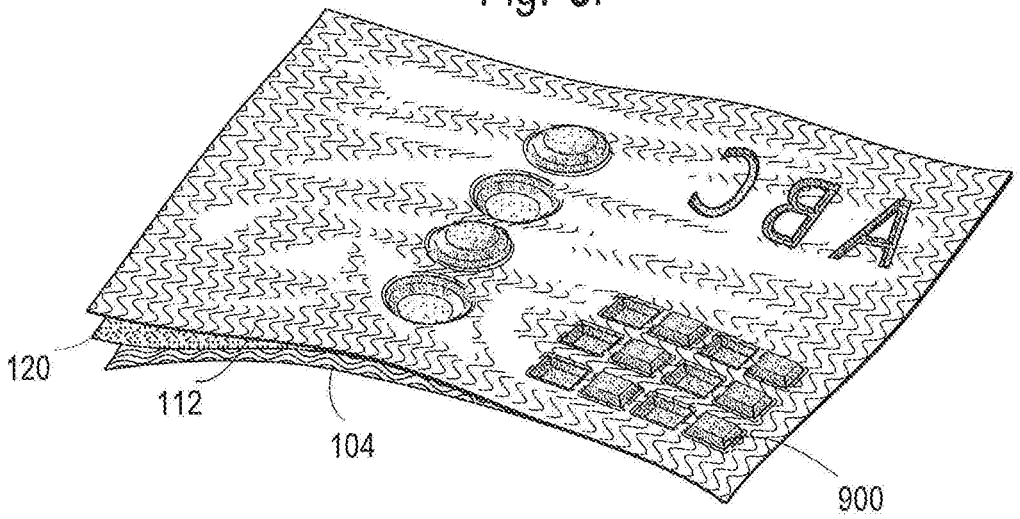
FIG. 9F is a perspective and partially exploded view of the reverse side of the knitted component of FIG. 9E.
Figure 9G:
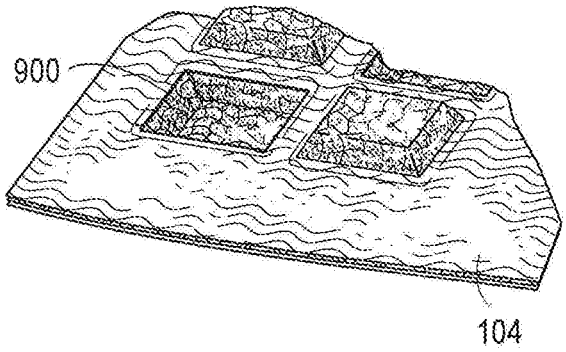
FIG. 9G is a close-up perspective view of a section of the knitted component of FIG. 9E.

In another aspect depicted in FIGS. 9E-G, the disclosure provides a method for creating a knitted component 100 having a multiple selected regions of macro-textures 900 and controlled stiffness after heat or pressure processing. In accordance with the method, a knitted component 100 comprising high-melting point polymer yarn 108 is knitted. A low-melting point thermoplastic strand 120 is inlaid in the selected region 128 of the knitted component 100 in a number and direction sufficient to yield the controlled stiffness after processing. The knitted component 100 is processed to soften the low-melting point thermoplastic strand 120. While the low-melting point thermoplastic yarn is softened, the knitted component is shaped using a mold press 400 having multiple macro-texture features 410. A sufficient amount of pressure is applied to the mold press 400 such that the softened low-melting point thermoplastic strand 120 deforms and the knitted component 100 conforms to the macro-texture features 410 in the mold press 400. After the knitted component 10 the low-melting point thermoplastic strand 120 has firmed, the knitted component 100 is removed from the mold press 400.

Figure 10A:
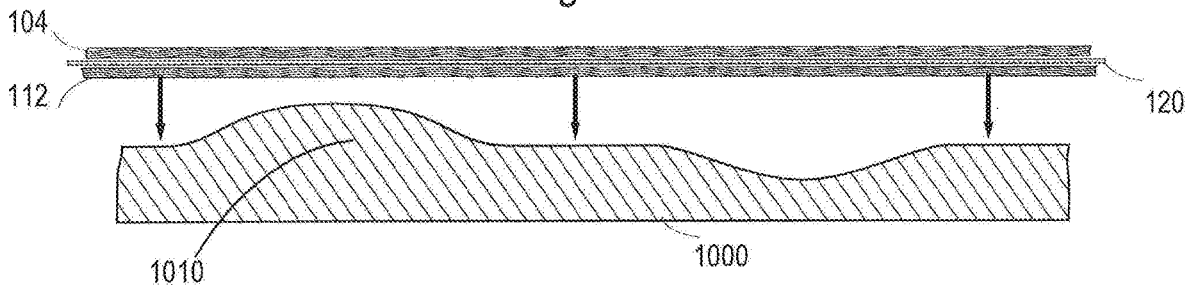
FIG. 10A a cross sectional view of the knitted component with a first and second knit layers and a low-melting point inly yarn before the knitted component is set into a slump mold.
Figure 10B:
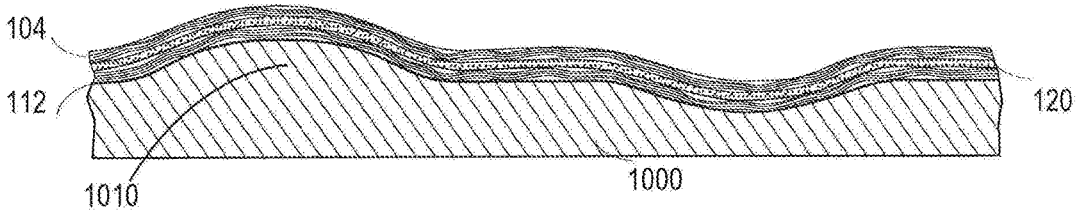
FIG. 10B a cross sectional view of the knitted component of FIG. 10A after the knitted component is set into the slump mold.
Figure 10C:
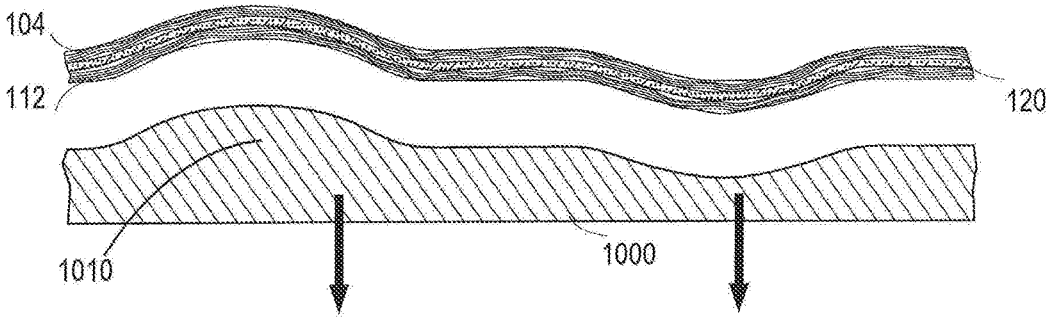
FIG. 10C a cross sectional view of the knitted component of FIGS. 10A and 10B after the knitted component is released from the slump mold.

In another aspect depicted in FIG. 10A the knitted component 100 is heated to soften the low-melting point thermoplastic strand 120 and positioned over a slump mold 1000 having a macro-texture 1010. As depicted in FIG. 10B, while the low-melting point thermoplastic strand 120 is softened, the knitted component is placed onto the slump mold 1000. After the knitted component 100 cools so that the low-melting point thermoplastic strand 120 has firmed, the knitted component 100 is removed from the slump mold 1000, as indicated in FIG. 10C.

Figure 11A:
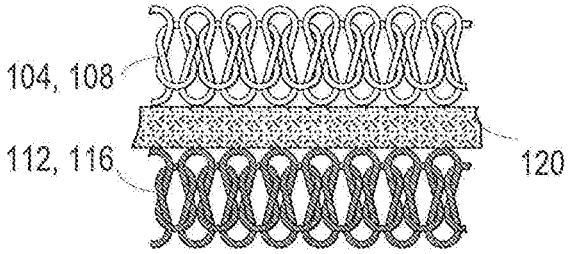
FIG. 11A is a cross section of a section of the knitted component after heating and molding showing a first low-melting point yarn knit layer, a re-solidified region of low-melting point thermoplastic inlaid strand, and a second low-melting point yarn knit layer where the high-melting point yarn knit layers make contact with the re-solidified region.
Figure 11B:
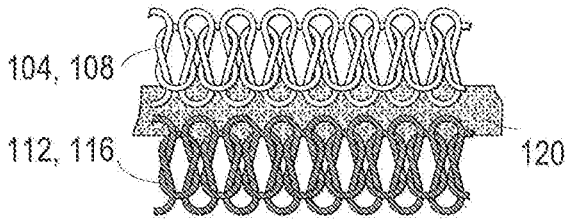
FIG. 11B is a cross section of a section of the knitted component after heating and molding showing a first low-melting point yarn knit layer, a re-solidified region of low-melting point thermoplastic inlaid strand, and a second low-melting point yarn knit layer where the high-melting point yarn knit layers, where the low-melting point yarn knit layers penetrate the re-solidified region.
Figure 11C:
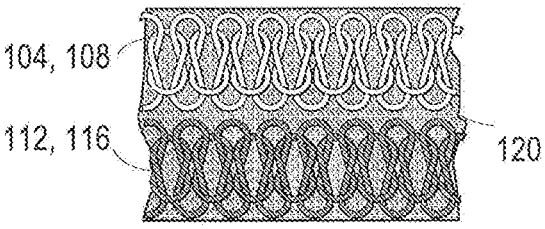
FIG. 11C is a cross section of a section of the knitted component after heating and molding showing a first low-melting point yarn knit layer, a re-solidified region of low-melting point thermoplastic inlaid strand, and a second low-melting point yarn knit layer where heat-resistant yarn knit layers are subsumed by the re-solidified region.

In another aspect depicted in FIG. 11A through FIG. 11C, varying amounts of low-melting point thermoplastic strand 120 or varying amounts of pressure can be applied to the heated knitted component 100 in the engaged mold press 400 to achieve varying levels of low-melting point thermoplastic yarn penetration into the knit layers 104, 112. Additional pressure applied to the cold press will allow the low-melting point thermoplastic strand 120 to penetrate the knit layers to a greater depth. This may result is negligible penetration FIG. 11A, significant penetration FIG. 11B, or complete penetration FIG. 11C as the amount of pressure increases or the amount of time pressure is applied increases. Similarly, using a higher volume ratio of low-melting point thermoplastic yarn to high-melting point thermoplastic yarn will allow the low-melting point thermoplastic yarn to penetrate into the knit layers at a greater depth, as depicted in FIGS. 11B and 11C. As the volume amount ratio of material increases, the low-melting point thermoplastic yarn can occupy a larger percentage of the empty space surrounding the high-melting point yarn of the knit layers, thus allowing for greater degrees of penetration.

When the thermoplastic strand 120 melts between the first layer 112 and the second layer 112, it may form a "third layer" comprised primarily of the thermoplastic material, as shown in FIG. 11B. When melted sufficiently, the third layer may form a water-resistant and/or waterproof barrier between the first layer 112 and the second layer. Advantageously, the knitted component may include outer surfaces that have a knit texture (often desirable in footwear for its soft/comfortable surface characteristics and aesthetics, for example) while also having desirable water-resistant properties. Further, it is contemplated that the thermoplastic material of the third layer may be primarily contained between the first layer 112 and the second layer 112 such that it is substantially absent from the outer surfaces of the knitted component.

The yarns used in embodiments may be selected from monofilament and multifilament yarns formed from synthetic materials. High-melting point polymer yarns 108, 116 also may be made from natural materials. Natural materials are not practical for low-melting point polymer yarns because the low-melting point polymer yarns must at least partially soften to be festively molded. Natural materials typically do not soften as synthetic thermoplastics do, but rather char; therefore, the use of natural materials may limit the range of processing temperatures that may be used in order to ensure that the knitted component is processed below the scorching temperature of the natural material. However, natural materials may be incorporated with a low-melting point thermoplastic yarn may be used as a low-melting point thermoplastic strand 120 layer.

Low-melting point thermoplastic yarn 120 typically is synthetic polymeric material formed from a polymer that melts at a relatively low temperature, generally below 150 C. The melting temperature of the low-melting point thermoplastic strand 120 may be sufficiently different from the melting temperature of the high-melting point polymer yarns 108, 116 that the low-melting point polymer strand 120 may be essentially completely melted without melting or adversely affecting the characteristics of the high-melting point polymer yarns 108, 116.

In some embodiments, the melting temperature of low-melting point polymer yarn is less than about 115° C., typically less than about 110° C., and more typically less than about 100° C. Synthetic polymer yarns that may be suitable as low-melting point polymer yarn include TPU yarns, low-melting point temperature PET, or low-melting point temperature nylon yarns. For example, low-melting point temperature nylon, which may be nylon-6, nylon-11, or nylon-12, may have a melting point of about 85° C. In some embodiments, polyurethane and polypropylene yarns may be used. In some embodiments, thermoplastic polyurethane (TPU) yarn may be used.

High-melting point polymer yarn, by definition, has a higher melting temperature than low-melting point thermoplastic yarns. The melting points of high-melting point polymer yarns typically greater than about 185° C., more typically greater than about 200° C., and even more typically greater than about 210° C. For example, nylon-6/11 has a melting point of at least about 195° C.; nylon-6/10 has a melting point of about 220° C., and nylon-6/6 has a melting point of at least about 255° C. These and other high-melting point polymer yarns may be used.

The yarns may be any color, and may be transparent, translucent, or opaque. These color and light properties and characteristics may be used to provide pleasing designs and color combinations. When the low-melting point polymer yarn is softened, the softened yarn may partially or fully surround the high-melting point polymer yarn. Thus, the colors of the yarns may combine where the yarns coincide. Examples of articles of footwear of the disclosure thus may be transparent, translucent, or opaque, depending most strongly on the properties and characteristics of the low-melting point polymer yarn. Softening the yarn typically does not change the color or light transmission properties of the resultant solid layer. In some embodiments, color and light transmission properties may be selected to provide selected effects.

The yarns may be selected from yarns that meet design criteria and may incorporate yarns made with different deniers and compositions of matter, for example. Also, typically, the high-melting point polymer yarns 108, 116 comprise different polymers from the low-melting point polymer yarns 120. More typically, the high-melting point polymer yarns 108, 116 will be different compositions of matter from the low-melting point polymer yarns 120. However, low-melting point polymer yarn made from low-melting point nylon may be used with high-melting point nylon yarns, with melt temperature difference sufficient to ensure that only the low-melting point polymer yarn melts when the knitted component is heated. In some embodiments, a composite material may be incorporated into a knitted component 100 either in one of the high-melting point yarns 108, 116 or in the low-melting point thermoplastic strand 120. Such a composite material typically comprises fibers in a binder.

Additionally, the inlaid strand 120 can be of a composite material to provide additional properties to the knitted component 100 such as strength, rigidity, elasticity, water-resistance, among others. The inlaid strand 120 may incorporate materials that are not low-melting point thermoplastics. However, to maintain the characteristics of the knit layers 104, 112, including the micro-texture of the knit layers 300, the knitted component 100 should not be heated above either the scorching or softening temperature of either of the high-melting point polymer yarns 108, 116 which comprise the knit layers. The inlaid strand 120 may also incorporate multiple strands and/or yarn 132. These multiple inlaid strands 132 may have similar or disparate properties, although at least one of the strands may incorporate a low-melting point thermoplastic material.

Figure 13:
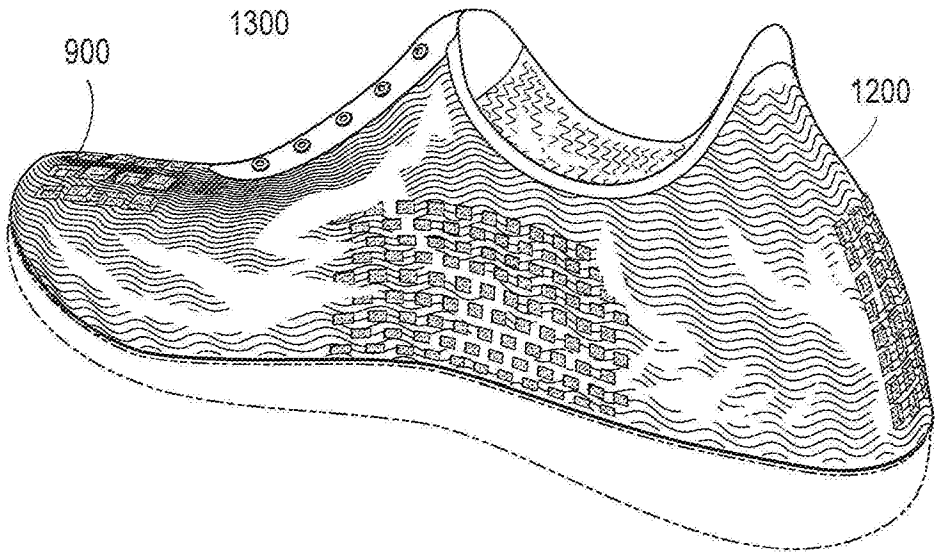
FIG. 13 is a perspective view of a completed shoe incorporating the textured upper of FIG. 12.
Figure 12:
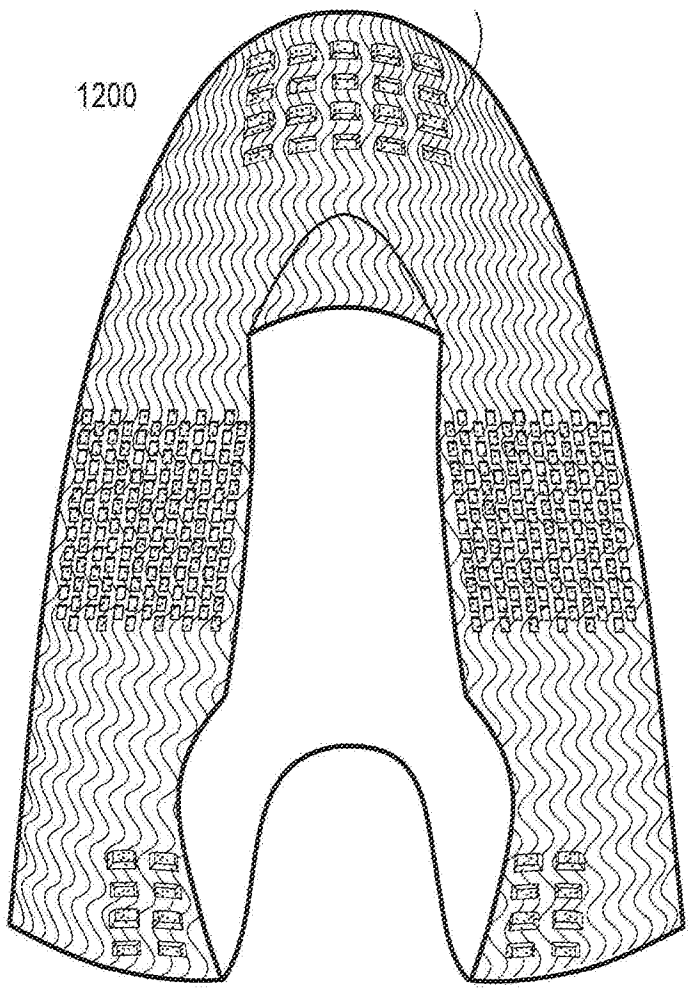
FIG. 12 is a top view of a knitted component upper for a shoe incorporating multiple macro-textured regions.

In another aspect depicted in FIGS. 12 and 13, the knitted component can be incorporated into an upper for a shoe or other wearable item. An article of footwear is depicted in FIG. 13 as including a sole structure 1300 and an upper 1200. Although the article of footwear is illustrated as having a general configuration suitable for running, concepts associated with footwear may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear apply to a wide variety of footwear types.

Although the disclosure is described in detail as it relates to a knitted component for an upper 1200 for an article of footwear, the principles described herein may be applied to any textile element to provide a region of stiffness and macro-structure 900 to an object. For example, the principles may be applied to textiles including, but not limited to, knitted textiles, and woven textiles. Knitted textiles include textiles formed by way of warp knitting, weft knitting, flat knitting, circular knitting, and other suitable knitting operations. The knitted textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, and double cloth weaves, for example.

Having described various aspects of the subject matter above, additional disclosure is provided below that may be consistent with the claims originally filed with this disclosure. In describing this additional subject matter, reference may be made to the previously described figures.

One general aspect includes a method of manufacturing a knitted component, including: knitting a first knit layer and a second knit layer on a knitting machine, where the first knit layer and the second knit layer each include a plurality of intermeshed loops, and where at least one loop of the first knit layer is intermeshed with at least one loop of the second knit layer; inlaying an inlaid strand between the first knit layer and the second knit layer during the knitting of the first knit layer and the second knit layer, where the inlaid strand includes a thermoplastic material having a melting point; applying heat to at least a portion of the thermoplastic material of the inlaid strand such that the portion of the thermoplastic material rises to a temperature at or above the melting point; applying a pressure to at least one side of the knitted component with a mold press to form a molded shape; and cooling the portion of the thermoplastic material to a temperature below the melting point during or after application of the pressure such that the molded shape is retained on at least one side of the knitted component.

Optionally, the step of cooling the portion of the thermoplastic material is at least partially executed by the mold press. The step of applying heat to the portion of the thermoplastic material may be executed prior to the step of applying the pressure to the at least one side of the knitted component. The mold press may include a temperature of less than the melting point during the step of applying the pressure to the at least one side of the knitted component. The portion of the thermoplastic material may form a barrier between the first knit layer and the second knit layer once the portion of the thermoplastic material is cooled, and where the barrier is water-resistant or waterproof. At least one of the first knit layer and the second knit layer may include a yarn having a melting point above the melting point of the thermoplastic material. At least one of the first knit layer and the second knit layer may include a polyester yarn.

Another general aspect includes a method of manufacturing a knitted component, including: knitting a first knit layer and a second knit layer on a knitting machine, where the first knit layer and the second knit layer each include a plurality of intermeshed loops, and where at least one loop of the first knit layer is intermeshed with at least one loop of the second knit layer; inlaying an inlaid strand between the first knit layer and the second knit layer during the knitting of the first knit layer and the second knit layer, where the inlaid strand includes a thermoplastic material having a melting point; applying heat to at least a portion of the thermoplastic material of the inlaid strand such that the portion of the thermoplastic material rises to a temperature at or above the melting point; and cooling the portion of the thermoplastic material to a temperature below the melting point such a barrier is formed between the first knit layer and the second knit layer, the barrier being water resistant or waterproof (e.g., as tested under ISO-11092(7.4)).

Another general aspect includes a knitted component, including: a first knit layer located on a first side of the knitted component; a second knit layer located on a second side of the knitted component that is opposite the first side, where the first knit layer includes at least one loop that is intermeshed with at least one loop of the second knit layer; and a third layer formed between the first knit layer and the second knit layer, where the third layer includes a thermoplastic material that is substantially contained between the first knit layer and the second knit layer.

Optionally, the knitted component may further include a molded shape located on at least one of the first side and the second side of the knitted component. At least one of the first knit layer and the second knit layer may include a yarn having a melting point that is higher than a melting point of the thermoplastic material. At least one of the first knit layer and the second knit layer may include a polyester yarn. The third layer may form a barrier between the first knit layer and the second knit layer that is water-resistant or waterproof. The thermoplastic material of the third layer may be provided via at least one inlaid strand that is inlaid between the first knit layer and the second knit layer.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An upper for an article of footwear, the upper comprising:

a first knit layer located on a first side of the upper;

a second knit layer located on a second side of the upper that is opposite the first side, wherein the first knit layer and/or the second knit layer comprise at least one high melting-point yarn; and a third layer formed between the first knit layer and the second knit layer, wherein the third layer includes one or more thermoplastic strands inlaid between the first knit layer and the second knit layer, wherein a first region of the upper includes a first ratio of the one or more thermoplastic strands to the at least one high melting-point yarn by volume, and wherein a second region of the upper includes a second ratio of the one or more thermoplastic strands to the at least one high melting-point yarn by volume, wherein the first ratio is greater than the second ratio.

2. The upper of claim 1, wherein the first region has a greater degree of penetration of the one or more thermoplastic strands into the first and second knit layers than the second region.

3. The upper of claim 1, wherein, in the first region, the one or more thermoplastic strands occupy a greater percentage of space between yarns forming the first and second knit layers compared to the second region.

4. The upper of claim 1, wherein the first region includes a first low-melting point thermoplastic yarn having a first melting temperature and the second region includes a second low-melting point thermoplastic yarn having a second melting temperature, the first and second melting temperatures each being less than a melting temperature of high melting-point yarn forming the first knit layer and the second knit layer.

5. The upper of claim 4, wherein the first and second melting temperatures are each less than 150° C.

6. The upper of claim 1, wherein the one or more thermoplastic strands inlaid in the first region extend from a first edge of the upper to a second edge of the upper.

7. The upper of claim 1, wherein the one or more thermoplastic strands inlaid in the second region extends from a first edge of the upper and partway to a second edge of the upper.

8. The upper of claim 1, wherein the first region has complete penetration of the first and second knit layers by the one or more thermoplastic strands, and the second region has partial penetration of the first and second knit layers by the one or more thermoplastic strands.

9. An article of footwear, comprising:

an upper having a first knit layer located on a first side of the upper;

a second knit layer located on a second side of the upper that is opposite the first side;

a third layer formed between the first knit layer and the second knit layer, wherein the third layer includes one or more thermoplastic strands inlaid between the first knit layer and the second knit layer, wherein a first region of the upper includes a first ratio of the one or more thermoplastic strands to high-melting point yarn by volume, and wherein a second region of the upper includes a second ratio of the one or more thermoplastic strands to high-melting point yarn by volume, wherein the first ratio is greater than the second ratio; and a sole structure secured to the upper.

10. The article of footwear of claim 9, wherein the third layer provides a waterproof barrier.

11. The article of footwear of claim 9, wherein the third layer provides a water-resistant barrier.

12. The article of footwear of claim 9, wherein the one or more thermoplastic strands comprise a first low-melting point yarn having a first melting temperature and being present in the first region and a second low-melting point yarn having a second melting temperature and being present in the second region, the first and second melting temperatures each being less than a melting temperature of yarn forming the first knit layer and the second knit layer.

13. The article of footwear of claim 12, wherein the first and second melting temperatures are each less than 150° C.

14. The article of footwear of claim 9, wherein the one or more thermoplastic strands inlaid in the first region extend from a first edge of the upper to a second edge of the upper.

15. The article of footwear of claim 9, wherein the one or more thermoplastic strands inlaid in the second region extend from a first edge of the upper and partway to a second edge of the upper.

16. An article of footwear, comprising:

an upper, comprising:

a knitted component, comprising:

a first knit layer, a second knit layer, and a thermoplastic material incorporated between the first knit layer and the second knit layer, wherein the thermoplastic material has been melted and re-solidified such that it penetrates through at least one of the first knit layer and the second knit layer and is exposed on an outer-facing surface of the upper.

17. The article of footwear of claim 16, wherein the re-solidified thermoplastic material forms a barrier between the first knit layer and the second knit layer, the barrier being water-resistant or waterproof.

18. The article of footwear of claim 16, wherein the thermoplastic material that is exposed on the outer-facing surface of the upper forms a smooth surface on the outer-facing surface of the upper.

19. The article of footwear of claim 16, wherein the thermoplastic material that is exposed on the outer-facing surface of the upper forms a flattened region on the outer-facing surface of the upper.

* * * * *